US008657937B2

(12) United States Patent
Motegi et al.

(10) Patent No.: US 8,657,937 B2
(45) Date of Patent: Feb. 25, 2014

(54) DUST COLLECTOR

(75) Inventors: Kanji Motegi, Osaka (JP); Ryuuji Akiyama, Osaka (JP); Shunji Haruna, Osaka (JP); Toshio Tanaka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 422 days.

(21) Appl. No.: 13/125,166

(22) PCT Filed: Aug. 27, 2009

(86) PCT No.: PCT/JP2009/004181

§ 371 (c)(1),
(2), (4) Date: Apr. 20, 2011

(87) PCT Pub. No.: WO2010/055600

PCT Pub. Date: May 20, 2010

(65) Prior Publication Data

US 2011/0197768 A1 Aug. 18, 2011

(30) Foreign Application Priority Data

Nov. 14, 2008 (JP) ..... 2008-292023

(51) Int. Cl.
*B03C 3/47* (2006.01)

(52) U.S. Cl.
USPC ..... 96/77; 96/86; 96/87; 96/98; 96/100

(58) Field of Classification Search
USPC ..... 96/75–79, 95–100, 84–87
See application file for complete search history.

(56) References Cited

U.S. PATENT DOCUMENTS

| | | | | | |
|---|---|---|---|---|---|
| 3,678,653 | A * | 7/1972 | Buschman | 96/66 |
| 5,322,550 | A * | 6/1994 | Park | 96/66 |
| 5,456,741 | A * | 10/1995 | Takahara et al. | 96/22 |
| 5,484,473 | A * | 1/1996 | Bontempi | 96/65 |
| 5,622,543 | A * | 4/1997 | Yang | 96/58 |
| 5,820,660 | A * | 10/1998 | Ko | 96/30 |
| 6,090,189 | A * | 7/2000 | Wikstrom et al. | 96/69 |
| 6,126,727 | A * | 10/2000 | Lo | 96/39 |
| 6,506,238 | B1 * | 1/2003 | Endo | 96/79 |
| 7,258,715 | B2 * | 8/2007 | Cox et al. | 55/422 |
| 8,192,535 | B2 * | 6/2012 | Tanaka et al. | 96/98 |
| 8,192,536 | B2 * | 6/2012 | Tanaka et al. | 96/98 |
| 2008/0034973 | A1 * | 2/2008 | Griffiths et al. | 96/58 |
| 2009/0199718 | A1 | 8/2009 | Tanaka et al. | |
| 2009/0277332 | A1 | 11/2009 | Tanaka et al. | |

FOREIGN PATENT DOCUMENTS

| | | | | |
|---|---|---|---|---|
| JP | 4-363157 | A * | 12/1992 | 96/96 |
| JP | 2001-276649 | A | 10/2001 | |
| JP | 2008-18425 | A | 1/2008 | |
| JP | 2008-18426 | A | 1/2008 | |

(Continued)

*Primary Examiner* — Richard L Chiesa
(74) *Attorney, Agent, or Firm* — Birch, Stewart, Kolasch & Birch, LLP.

(57) ABSTRACT

Each protrusion (42) of a first electrode (40) is formed to have a long plate-like shape extending across a plurality of grid holes (46) of the first electrode (40). Each grid hole (56) of a second electrode (50) is formed to have an elongate shape extending to conform to each corresponding one of the protrusions (42) of the first electrode (40). Protrusions (52) of the second electrode (50) are arranged in the longitudinal direction at end portions (54*a*) on the long sides of the respective grid holes (56) of the second electrode (50), so as to conform to the grid holes (46) of the first electrode (40).

7 Claims, 6 Drawing Sheets

(56) References Cited

FOREIGN PATENT DOCUMENTS

| | | | |
|---|---|---|---|
| JP | 2009-82911 | A | 4/2009 |
| JP | 2009-82912 | A | 4/2009 |
| JP | 2009-214048 | A | 9/2009 |
| WO | WO 2005/115627 | A1 | 12/2005 |
| WO | WO 2005/115628 | A1 | 12/2005 |

* cited by examiner

DUST COLLECTOR

This application is a national stage application of International Application No. PCT/JP2009/004181, filed on Aug. 27, 2009.

TECHNICAL FIELD

This invention relates to dust collectors that collect dust from an air to be processed onto the dust collecting surfaces of electrodes by forming electric fields between the electrodes, and more particularly to measures to achieve higher dust collecting efficiencies.

BACKGROUND ART

Dust collectors that collect dust from an air to be processed have been known. As a dust collector of this type, Patent Document 1 discloses a dust collector using two grid-like electrodes.

The dust collector includes a first electrode, a second electrode, and a power supply for applying a voltage to both electrodes. The first electrode and the second electrode substantially have the same structures. Specifically, each of those electrodes includes a base having a grid structure, and protrusions protruding in the axial direction of the grid holes from the base. The protrusions are formed at the side end portions of the respective grid holes. That is, in those electrodes, there is a one-to-one correspondence between the side end portions of the grid holes and the protrusions. In the dust collector, the two electrodes are positioned to face each other, so that the protrusions of the first electrode are inserted into the grid holes of the second electrode, and the protrusions of the second electrode are inserted into the grid holes of the first electrode.

When a voltage is applied to both electrodes, an electric field is formed between the first electrode and the second electrode, and dust collecting surfaces for collecting dust from the air to be processed are formed on the surfaces of the first electrode. Specifically, as electric fields are formed between the inner peripheral faces of the grid holes of the first electrode and the protrusions of the second electrode, dust collecting surfaces are formed on the inner peripheral faces of the grid holes of the first electrode. Also, since an electric field is formed between the protrusions of the first electrode and the inner peripheral faces of the grid holes of the second electrode, dust collecting surfaces are formed on the outer peripheral faces of the protrusions of the first electrode. Dust in the air to be processed is drawn to and collected onto those dust collecting surfaces. As a result, the air to be processed is cleaned.

CITATION LIST

Patent Document

Patent Document 1: Japanese Patent Publication No. 2008-18425

SUMMARY OF THE INVENTION

Technical Problem

As described above, in the dust collector disclosed in Patent Document 1, two electrodes each having a base and protrusions are positioned to face each other, so that dust collecting surfaces are formed on the inner peripheral faces of the grid holes of the first electrode and on the outer peripheral faces of the protrusions of the first electrode. In this structure, however, the areas of the outer peripheral faces of the protrusions of the first electrode are smaller than the areas of the inner peripheral faces of the grid holds of the first electrode, because the protrusions of the first electrode are to be inserted into the grid holes of the second electrode each having substantially the same inner diameter as the inner diameter of each of the grid holes of the first electrode. Therefore, if the areas of the outer peripheral faces of the protrusions of the first electrode can be made larger, the dust collecting areas can be made larger, and a higher dust collecting efficiency can be achieved accordingly.

The present invention has been made in view of the above described points, and an object thereof is to provide a dust collector that is small in size but has large dust collecting areas.

Solution to the Problem

A first aspect of the invention is directed to a dust collector that includes first and second electrodes (40, 50) including bases (41, 51) each having a grid structure, and a plurality of protrusions (42, 52) protruding in the axial direction of grid holes (46, 56) from the bases (41, 51), respectively, the two electrodes (40, 50) being positioned to face each other, each of the protrusions (42) of the first electrode (40) being inserted into each corresponding one of the grid holes (56) of the second electrode (50), each of the protrusions (52) of the second electrode (50) being inserted into each corresponding one of the grid holes (46) of the first electrode (40), dust collecting surfaces to collect dust from an air to be processed being formed on surfaces of the first electrode (40). In this dust collector, each of the protrusions (42) of the first electrode (40) is formed to have a long plate-like shape extending across adjacent ones of the grid holes (46) of the first electrode (40), each of the grid holes (56) of the second electrode (50) is formed as an elongate hole extending to conform to each corresponding one of the protrusions (42) of the first electrode (40), and the protrusions (52) of the second electrode (50) are arranged in the longitudinal direction at the end portions (54*a*) on the long sides of the grid holes (56) of the second electrode (50), to conform to the respective grid holes (46) of the first electrode (40).

In the first aspect of the invention, the first electrode (40) and the second electrode (50) include the bases (41, 51) and the protrusions (42, 52), respectively. The protrusions (52) of the second electrode (50) are inserted into the grid holes (46) of the base (41) of the first electrode (40). The protrusions (42) of the first electrode (40) are inserted into the grid holes (56) of the base (51) of the second electrode (50). In the dust collector, dust collecting surfaces are formed on the outer peripheral faces of the protrusions (42) of the first electrode (40) and on the inner peripheral faces of the grid holes (46) of the first electrode (40), and dust in the air to be processed is collected onto the dust collecting surfaces.

According to the present invention, each of the protrusions (42) of the first electrode (40) is formed in a long plate-like shape extending across two or more adjacent grid holes (46) of the first electrode (40). That is, in the dust collector of the described example, there is a one-to-one correspondence between the protrusions and the grid holes in the first electrode. In the first electrode (40) of the present invention, on the other hand, each protrusion is formed to extend across a plurality of grid holes so that each protrusion corresponds to a plurality of adjacent grid holes. In the second electrode (50), the grid holes (56) are formed as elongate holes to conform to the long plate-like protrusions (42) of the first electrode (40). Accordingly, the protrusions (42) of the first electrode (40) can be made longer than those of the described example. As a result, the areas of the outer peripheral faces of the protrusions (42) of the first electrode (40) can be made larger than the areas of the outer peripheral faces of the protrusions of the described example.

Also, in the second electrode (50), the plurality of protrusions (52) are arranged in the longitudinal direction at the end portions (54*a*) on the long sides of the respective grid holes (56) formed as elongate holes. Each of the protrusions (52) of the second electrode (50) is inserted into each corresponding one of the grid holes (46) of the first electrode (40). Accordingly, the areas of the inner peripheral faces of the grid holes (46) of the first electrode (40) can be made equal to the areas of the inner peripheral faces of the grid holes of the described example.

As described above, in the first aspect of the invention, the areas of the outer peripheral faces of the protrusions (42) of the first electrode (40) can be made larger than those of the dust collector of the described example, while the areas of the inner peripheral faces of the grid holes (46) of the first electrode (40) remain the same as those of the dust collector of the described example.

A second aspect of the invention is the dust collector according to the first aspect of the invention, wherein each of the protrusions (42) of the first electrode (40) is formed in a long plate-like shape extending across three or more adjacent ones of the grid holes (46) of the first electrode (40).

In the second aspect of the invention, each of the protrusions (42) of the first electrode (40) is formed to extend across three or more adjacent ones of the grid holes (46), and the grid holes (56) of the second electrode (50) are formed as elongate holes to conform to the long plate-like protrusions (42). With this arrangement, the areas of the outer peripheral faces of the protrusions (42) of the first electrode (40) can be made larger than the areas of the outer peripheral faces of the protrusions of the described example.

A third aspect of the invention is the dust collector according to the first or second aspect of the invention, wherein the first electrode (40) and the second electrode (50) are positioned so that respective first partitions (55) as the short sides of the end portions (54*a*) of the respective grid holes (56) of the second electrode (50) overlap with second partitions (45) of end portions of the grid holes (46) of the first electrode (40) in the axial direction of the grid holes (46, 56), the second partitions (45) being parallel to the first partitions (55).

In the third aspect of the invention, the respective first partitions (55) on the short sides of the end portions (54*a*) of the grid holes (56) of the second electrode (50) are positioned to overlap with the second partitions (45) of the first electrode (40) in the axial direction of the grid holes (46, 56). If the respective first partitions (55) are misaligned and do not overlap with the second partitions (45) in the axial direction, the flow passage resistance (the airflow resistance) to the air passing through the respective grid holes (46, 56) becomes higher. In the present invention, on the other hand, the respective first partitions (55) overlap with the second partitions (45) in the axial direction of the grid holes (46, 56). Accordingly, the flow passage resistance (the airflow resistance) to the air passing through the respective grid holes (46, 56) is restricted to the minimum necessary value.

A fourth aspect of the invention is the dust collector according to any one of the first through third aspects of the invention, wherein the second electrode (50) is made of a conductive resin material.

In the fourth aspect of the invention, the second electrode (50) is made of a conductive resin material. In the second electrode (50) made of the resin material, the grid holes (56) are formed as elongate holes, as described above. Therefore, the number of partitions for the grid holes (46) is smaller than that in the first electrode (40). Accordingly, the amount of the raw resin material required for manufacturing the second electrode (50) is smaller.

A fifth aspect of the invention is the dust collector according to any one of the first through fourth aspects of the invention, wherein the first electrode (40) is made of a metal material.

In the fifth aspect of the invention, the first electrode (40) is made of a metal material. In the first electrode (40) made of the metal material, each of the protrusions (42) is formed to have a long plate-like shape, as described above. Therefore, the number of protrusions (42) is smaller than that in the second electrode (50). Accordingly, the process for manufacturing the first electrode (40) becomes easier.

A sixth aspect of the invention is the dust collector according to any one of the first through fifth aspects of the invention, wherein the base (41) of the first electrode (40) is located closer to the upstream side of the flow of the air to be processed than the base (51) of the second electrode (50) is.

In the sixth aspect of the invention, the base (41) of the first electrode (40) is located closer to the upstream side than the protrusions (42) of the first electrode (40) are. Here, the areas of the inner peripheral faces (dust collecting surfaces) of the grid holes (46) of the first electrode (40) easily become larger than the areas of the outer peripheral faces (dust collecting surfaces) of the protrusions of the first electrode (40). In the dust collector, the amount of dust in the air to be processed becomes smaller toward the downstream side. Accordingly, in the present invention, a large amount of dust in the air to be processed is efficiently removed at the base (41) of the first electrode (40), and a small amount of dust not having been collected at the base (41) can be efficiently removed by the protrusions (42) of the first electrode (40).

A seventh aspect of the invention is the dust collector according to any one of the first through sixth aspects of the invention, wherein the aspect ratio of each of the grid holes (46) of the first electrode (40) is 4 or lower.

In the seventh aspect of the invention, the aspect ratio of each of the grid holes (46) of the first electrode (40) is set at 4 or lower. Accordingly, the dust collecting areas on a base can be made larger than the dust collecting areas on the same base used in a case where the aspect ratio of each of the grid holes (46) of the first electrode (40) is higher than 4.

Advantages of the Invention

In the present invention, each of the protrusions (42) of the first electrode (40) is formed to have a long plate-like shape extending across a plurality of grid holes (46) of the first electrode (40), and the grid holes (56) of the second electrode (50) are formed as elongate holes to conform to the protrusions (42). Accordingly, the areas of the outer peripheral faces of the first electrode (40) become larger. Furthermore, the plurality of protrusions (52) are arranged along the grid holes (56) of the second electrode (50), and each of the protrusions (52) is inserted into a corresponding grid hole (46) of the first electrode (40). Accordingly, the areas of the inner peripheral faces of the grid holes (46) of the first electrode (40) also become relatively large. As a result, according to the present invention, the areas of the dust collecting surfaces of the first electrode (40) become larger than those of the described example. Thus, a dust collector that is relatively small in size and has a high dust collecting efficiency can be provided.

Also, in the first electrode (40), the number of protrusions (42) can be made smaller than that in the described example, and the manufacturing costs can be lowered accordingly. Also, in the second electrode (50), the number of grid holes (56) or the number of grid walls can be made smaller than that in the described example, and the manufacturing costs can be lowered accordingly. Further, the grid holes (56) of the second electrode (50) are larger in the longitudinal direction. Accordingly, the airflow resistance of the grid holes (56) can be lowered, and pressure loss is reduced. Thus, the power required for driving a fan or the like can be reduced.

Particularly, in the second aspect of the invention, each of the protrusions (42) of the first electrode (40) is formed to have a long plate-like shape extending across three or more grid holes (46) of the first electrode (40). Accordingly, the areas of the outer peripheral faces of the protrusions (42) of the first electrode (40) can be effectively made larger. Also, the number of protrusions (42) of the first electrode (40) can be effectively made smaller, and the number of grid walls of the second electrode (50) can be effectively made smaller. Further, the airflow resistance of the grid holes (56) of the second electrode (50) can be effectively lowered.

Further, in the third aspect of the invention, the first electrode (40) and the second electrode (50) are positioned so that the respective first partitions (55) of the second electrode (50) overlap with the second partitions (45) of the first electrode (40) in the axial direction of the grid holes (46, 56). Accordingly, the airflow resistance to the air successively passing through the respective grid holes (46, 56) of the first electrode (40) and the second electrode (50) can be restricted to the minimum value. As a result, the pressure loss of the dust collecting electrode can be reduced, and the power required for driving the fan or the like for conveying the air can be reduced.

In the fourth aspect of the invention, the second electrode (50) is made of a conductive resin material. Accordingly, the amount of the raw resin material can be reduced by the reduction in the number of grid walls, and the manufacturing costs can be lowered. In the fifth aspect of the invention, the first electrode (40) is made of a metal material. Accordingly, processing the metal material of the first electrode (40) can be made easier by the reduction in the number of protrusions (42), and the manufacturing costs can be lowered.

According to the sixth aspect of the invention, the base (41) of the first electrode (40) is located closer to the upstream side than the base (51) of the second electrode (50) is. Accordingly, dust in the air on the upstream side can be sufficiently captured by the inner peripheral faces of the grid holes (46) of the first electrode (40) having relatively large dust collecting areas. As a result, the period of time before the dust collecting surfaces of the first electrode (40) are covered with dust becomes longer, and accordingly, the frequency of maintenance can be lowered.

In the seventh aspect of the invention, the aspect ratio of each of the grid holes (46) of the first electrode (40) is 4 or lower. Accordingly, the areas of the inner peripheral faces of the grid holes (46) of the first electrode (40) become relatively large, and a dust collector that is small in size and has a high dust collecting efficiency can be provided.

BRIEF DESCRIPTION OF THE DRAWINGS

FIG. 4(A) is a plan view of the dust collecting electrode, seen from dust-collecting-side protruding plates. FIG. 4(B) is a vertical cross-sectional view of the dust collecting electrode. FIG. 4(C) is a vertical cross-sectional view of the high-voltage electrode. FIG. 4(D) is a plan view of the high-voltage electrode, seen from high-voltage-side protruding plates.

FIG. 5(A) is a plan view of the dust collecting electrode, seen from the dust-collecting-side protruding plates. FIG. 5(B) is a vertical cross-sectional view of the dust collecting part. FIG. 5(C) is a plan view of the high-voltage electrode, seen from the high-voltage-side protruding plates.

FIG. 6(A) is a plan view of the dust collecting electrode, seen from the dust-collecting-side protruding plates. FIG. 6(B) is a vertical cross-sectional view of the dust collecting part. FIG. 6(C) is a plan view of the high-voltage electrode, seen from the high-voltage-side protruding plates.

FIG. 7(A) is a plan view of the dust collecting electrode, seen from the dust-collecting-side protruding plates. FIG. 7(B) is a vertical cross-sectional view of the dust collecting part. FIG. 7(C) is a plan view of the high-voltage electrode, seen from the high-voltage-side protruding plates.

DESCRIPTION OF EMBODIMENTS

Embodiments of the present invention will be specifically described below with reference to the drawings. It should be noted that the embodiments described below are merely preferred examples, and do not limit the present invention and the range of application or use of the present invention.

An air purifier (10) according to this embodiment is a household air purification system used at home or a small store, for example, and forms a dust collector according to the present invention.

<General Structure of the Air Purifier>

Figure 1:
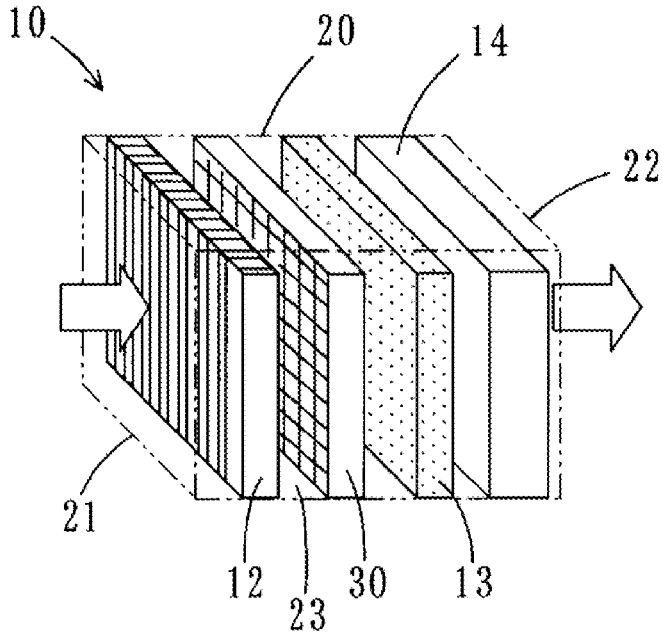
FIG. 1 is a schematic perspective view showing the general structure of an air purifier according to an embodiment.
Figure 2:
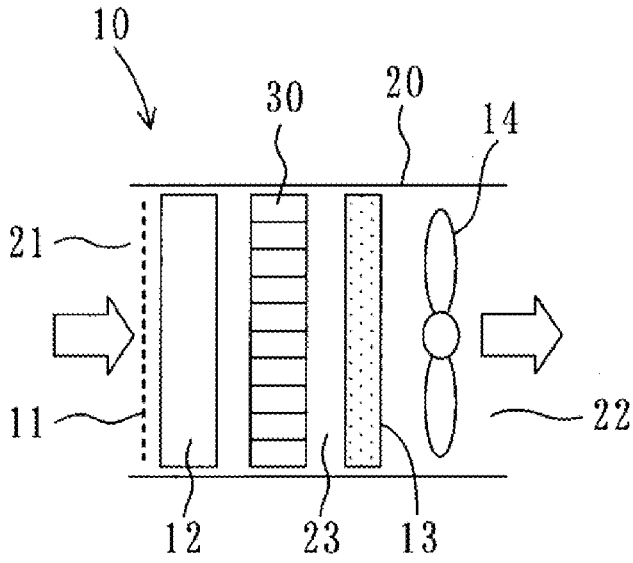
FIG. 2 is a schematic structural view showing the inside of the air purifier according to the embodiment.

As shown in FIGS. 1 and 2, the air purifier (10) includes a casing (20), and also includes a prefilter (11), a charging part (12), a dust collecting part (30), a catalyst filter (13), and a fan (14) that are contained in the casing (20).

The casing (20) is formed in a rectangular, horizontally long container, for example. The front surface of the casing (20) forms an air inlet (21), the back surface forms an air outlet (22), and the interior forms an air passage (23). The prefilter (11), the charging part (12), the dust collecting part (30), the catalyst filter (13), and the fan (14) are arranged in this order from the inlet (21) toward the outlet (22).

The prefilter (11) serves as a filter for collecting relatively large dust in the air taken through the inlet (21) into the casing (20).

The charging part (12) serves as an ionizer to electrically charge relatively small dust having passed through the prefilter (11). Although not shown, the charging part (12) includes a plurality of ionizing wires and a plurality of facing electrodes, and is designed so that a direct-current voltage is applied between each pair of an ionizing wire and a facing electrode. The ionizing wires are positioned to extend from the upper end to the lower end of the charging part (12), and each one of the facing electrodes is placed between each two adjacent ones of the ionizing wires. The dust in the air to be processed is positively charged at the charging part (12).

The dust collecting part (30) is designed to collect dust electrically charged at the charging part (12) by absorption. The dust collecting part (30) will be described later in detail.

Although not shown, the catalyst filter (13) is formed with a catalyst carried on the surface of a support material having a honeycomb structure, for example. Examples of applicable catalysts include manganese catalysts and precious metal catalysts. The catalyst decomposes toxic substances and odorous substances in the air from which dust has been removed through the dust collecting part (30).

The fan (14) is placed at the most downstream side of the air passage (23) in the casing (20). The fan (14) is designed to draw room air into the casing (20) and then blow clean air to the room.

<Structure of Dust Collecting Part>

Figure 3:
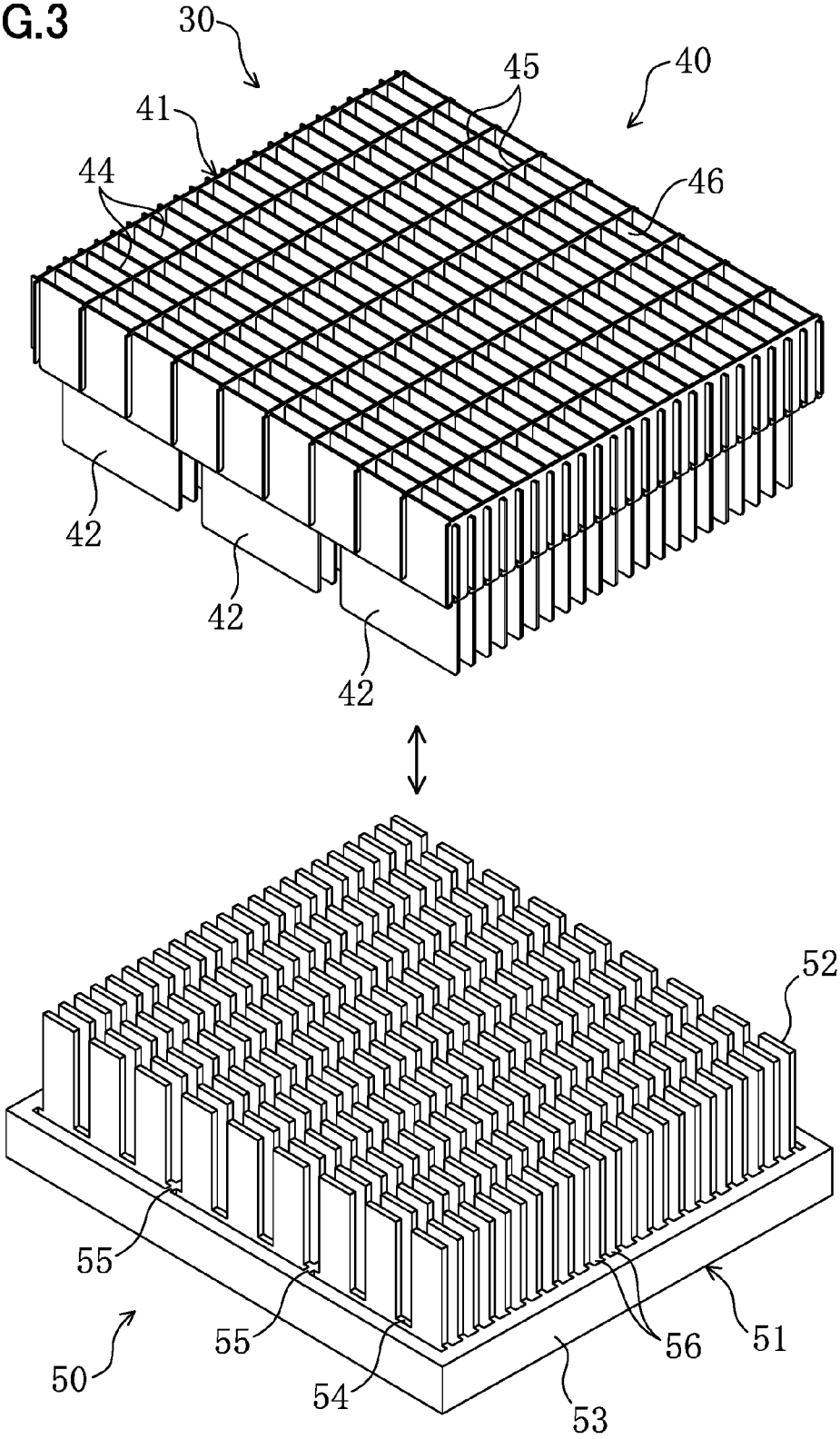
FIG. 3 is a perspective view showing the general structure of a dust collecting part according to the embodiment, with a dust collecting electrode and a high-voltage electrode being separated from each other.
Figure 4:
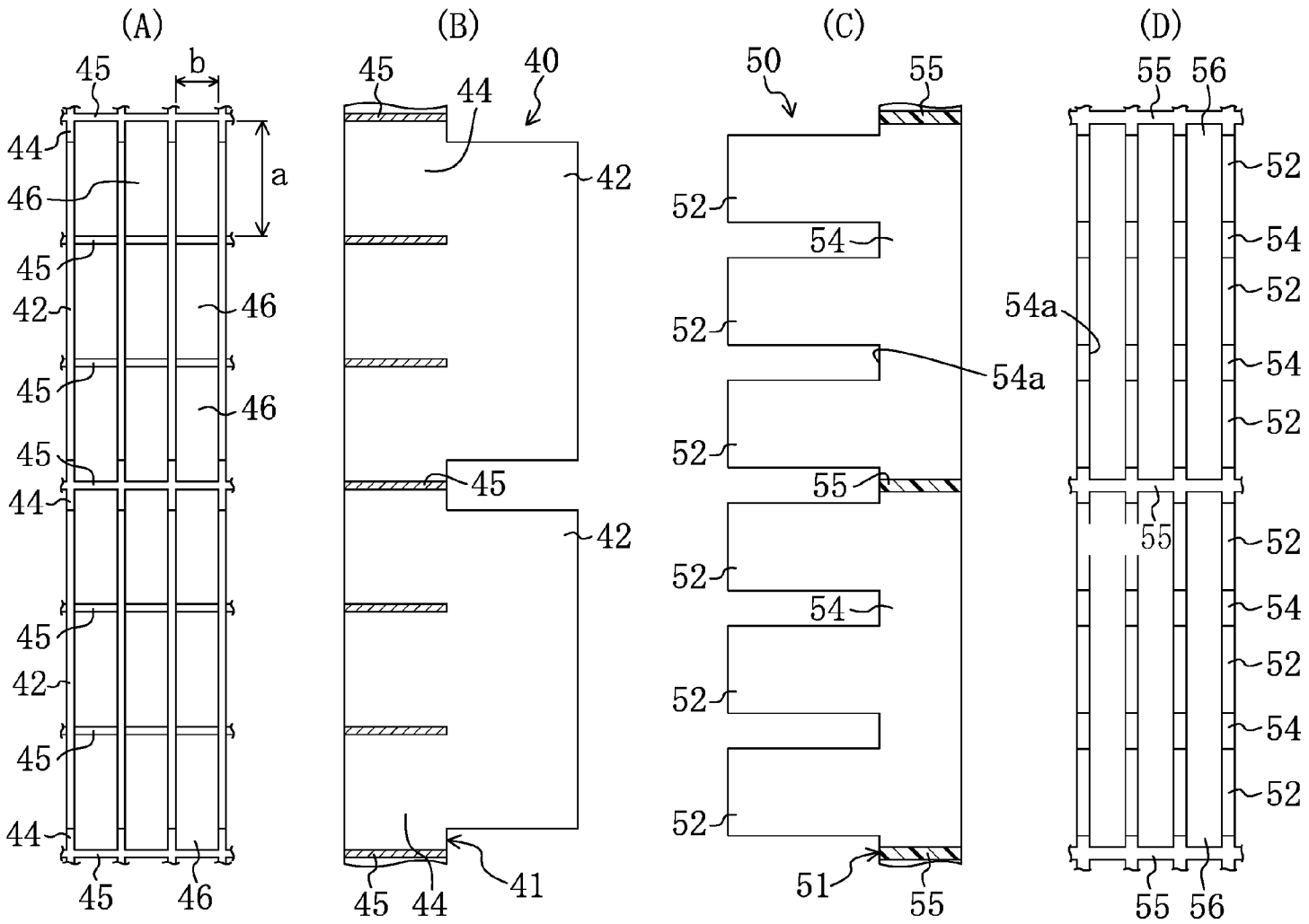
FIG. 4 illustrate the dust collecting electrode and the high-voltage electrode according to the embodiment.
Figure 5:
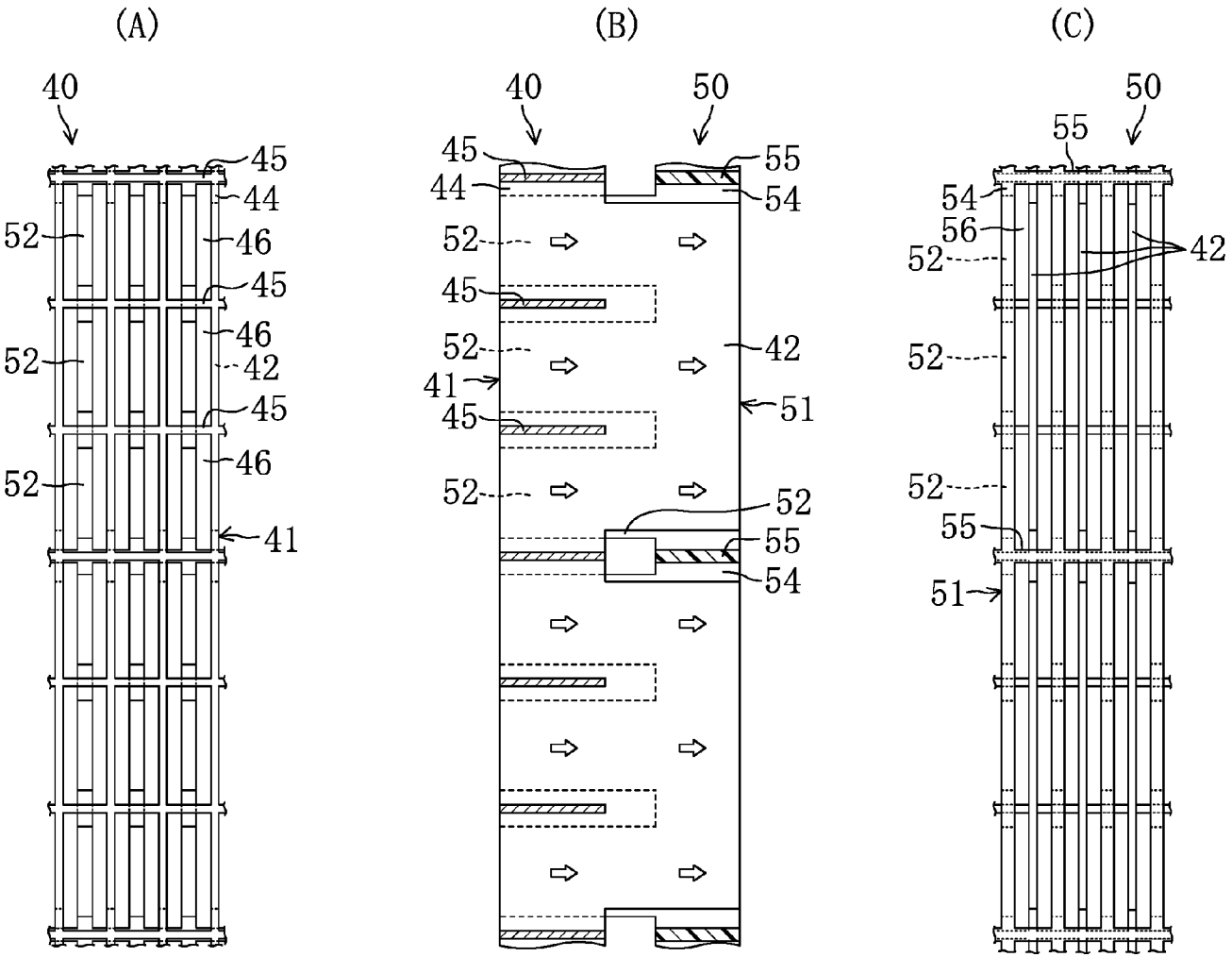
FIG. 5 illustrate a situation where the dust collecting electrode and the high-voltage electrode according to the embodiment are assembled together.

Referring now to FIGS. 3-5, the structure of the dust collecting part (30) is described in detail. The dust collecting part (30) includes a dust collecting electrode (40) as a first electrode, and a high-voltage electrode (50) as a second electrode. The dust collecting electrode (40) and the high-voltage electrode (50) are connected to a direct-current power supply, and a voltage is applied from the direct-current power supply to both of the electrodes (40, 50). Specifically, the dust collecting electrode (40) is connected to the ground side, and the high-voltage electrode (50) is connected to the positive side of the direct-current power supply. With this arrangement, the dust positively charged at the charging part (12) is collected onto the surfaces of the dust collecting electrode (40). That is, dust collecting surfaces for collecting dust in the air to be processed are formed on the surfaces of the dust collecting electrode (40).

The dust collecting electrode (40) is made of a metal material, and, more specifically, is formed by a thin metal plate of conductive stainless spring steel. On the other hand, the high-voltage electrode (50) is made of a conductive resin material. The high-voltage electrode (50) is integrally formed by injection molding or the like. The material of the high-voltage electrode (50) is preferably a slightly conductive resin, and the volume resistivity of the resin is preferably between $10^8$ Ωcm (inclusive) and $10^{13}$ Ωcm (inclusive).

The dust collecting electrode (40) and the high-voltage electrode (50) have substantially the same shapes, and are designed to have an insertion structure in which the dust collecting electrode (40) and the high-voltage electrode (50) can be partially inserted into each other (see FIG. 3). The dust collecting electrode (40) is located closer to the upstream side of the airflow in the air passage (23), and the high-voltage electrode (50) is located closer to the downstream side of the airflow in the air passage (23).

The dust collecting electrode (40) includes a dust-collecting-side base (41) and dust-collecting-side protruding plates (42). Further, the dust-collecting-side base (41) includes a plurality of vertical partitions (44) and a plurality of horizontal partitions (45).

The vertical partitions (44) and the horizontal partitions (45) each have a plate-like shape, and are arranged parallel to one another at predetermined intervals. In the dust-collecting-side base (41), the intervals between the vertical partitions (44) are shorter than the intervals between the horizontal partitions (45).

The dust-collecting-side base (41) forms a base having a quadrangular grid structure, as the vertical partitions (44) and the horizontal partitions (45) are assembled together so as to be perpendicular to each other. In the dust-collecting-side base (41), rectangular grid holes (46) are defined by the vertical partitions (44) and the horizontal partitions (45).

The aspect ratio of each of the grid holes (46) of the dust collecting electrode (40) is between 2.0 (inclusive) and 4.0 (inclusive). Here, the aspect ratio indicates the ratio of a to b (a/b), where a represents the length of each grid hole (46) in the vertical direction, and b represents the length of each grid hole (46) in the horizontal direction (see FIG. 4).

The plurality of dust-collecting-side protruding plates (42) are fowled at the end portions in the width direction of the vertical partitions (44) of the dust-collecting-side base (41) (or in the axial direction of the grid holes (46)). That is, the dust-collecting-side protruding plates (42) form protrusions that protrude in the axial direction of the grid holes (46) from the dust-collecting-side base (41). The vertical partitions (44) and the dust-collecting-side protruding plates (42) form an integral single metal plate.

Each of the dust-collecting-side protruding plates (42) is formed in a long plate-like shape that extends across three adjacent grid holes (46) of the dust-collecting-side base (41). In other words, each of the dust-collecting-side protruding plates (42) is formed in a long plate-like shape that extends across a plurality of grid holes (46) adjacent to one another in the same row and extends in the longitudinal direction of the vertical partitions (44) (or in the vertical direction in FIG. 4, for example). In this embodiment, three dust-collecting-side protruding plates (42) are arranged in a line for each one of the vertical partitions (44) (see FIG. 3).

The high-voltage electrode (50) includes a high-voltage-side base (51) and high-voltage-side protruding plates (52). Further, the high-voltage side base (51) includes a frame (53), a plurality of vertical partitions (54), and a plurality of horizontal partitions (55). Also, in the dust collecting part (30), the dust-collecting-side base (41) is placed closer to the upstream side of the airflow in the air passage (23) than the high-voltage-side base (51) is.

The frame (53) is formed in a rectangular shape, and the vertical partitions (54) and the horizontal partitions (55) are integrally supported in the frame (53). The vertical partitions (54) and the horizontal partitions (55) each have a plate-like shape, and are arranged parallel to one another at predetermined intervals. The thicknesses of the vertical partitions (54) and horizontal partitions (55) of the high-voltage-side base (51) are greater than the thicknesses of the vertical partitions (44) and horizontal partitions (45) of the dust-collecting-side base (41). Also, in the high-voltage-side base (51), the intervals between the vertical partitions (54) are shorter than the intervals between the horizontal partitions (55).

The high-voltage-side base (51) forms a base having a quadrangular grid structure, as the plurality of vertical partitions (54) and the plurality of horizontal partitions (55) are assembled together so as to be perpendicular to each other. In the high-voltage-side base (51), a plurality of grid holes (56) are defined by the vertical partitions (54) and the horizontal partitions (55).

Each of the grid holes (56) of the high-voltage electrode (50) is formed as an elongate hole that extends in the extending direction of the dust-collecting-side protruding plates (42) (or in the vertical direction in FIG. 4) so as to face each corresponding one of the dust-collecting-side protruding plates (42). In other words, the grid holes (56) of the high-voltage electrode (50) each have a vertically long rectangular shape that extends in the longitudinal direction of the vertical partitions (54), so as to substantially correspond to each three adjacent grid holes (46, 46, 46) of the dust collecting electrode (40).

The aspect ratio of each of the grid holes (56) of the high-voltage electrode (50) is higher than the aspect ratio of each of the grid holes (46) of the dust collecting electrode (40). In this embodiment, the aspect ratio of each of the grid holes (56) of the high-voltage electrode (50) is three times as high as the aspect ratio of each of the grid holes (46) of the dust collecting electrode (40). That is, the dust collecting part (30) of this embodiment is designed so that the aspect ratio of each of the grid holes (56) of the high-voltage electrode (50) becomes equal to an integral multiple of (three times, in this embodiment) the aspect ratio of each of the grid holes (46) of the dust collecting electrode (40). It should be noted that the aspect ratio of each of the grid holes (56) of the high-voltage electrode (50) is not necessarily equal to an integral multiple of the aspect ratio of each of the grid holes (46) of the dust collecting electrode (40).

The plurality of high-voltage-side protruding plates (52) are formed at the end portions in the width direction of the vertical partitions (54) of the high-voltage-side base (51) (or in the axial direction of the grid holes (56)). That is, the high-voltage-side protruding plates (52) form protrusions that protrude in the axial direction of the grid holes (56) from the high-voltage-side base (51). The length of each of the high-voltage-side protruding plates (52) in its width direction (the longitudinal direction of the vertical partitions (54)) is smaller than the length of each of the dust-collecting-side protruding plates (42) in its width direction (the longitudinal direction of the vertical partitions (44)). In each of the vertical partitions (54) of the high-voltage-side base (51), a plurality of high-voltage-side protruding plates (52) are arranged in the longitudinal direction of the grid holes (56) at end portion (54*a*) of each corresponding grid hole (56). Specifically, in the high-voltage electrode (50), three high-voltage-side protruding plates (52) are arranged at predetermined intervals along each grid hole (56), and the respective high-voltage-side protruding plates (52) face the respective grid holes (46) of the dust collecting electrode (40), with a one-to-one correspondence existing between the high-voltage-side protruding plates (52) and the grid holes (46).

When the dust collecting electrode (40) and the high-voltage electrode (50) are assembled together, as shown in FIG. 5, the respective dust-collecting-side protruding plates (42) are inserted into the respective grid holes (56) of the high-voltage electrode (50), and the respective high-voltage-side protruding plates (52) are inserted into the respective grid holes (46) of the dust collecting electrode (40). The dust collecting electrode (40) and the high-voltage electrode (50) are positioned to face each other at a predetermined distance from each other so that the dust-collecting-side base (41) and the high-voltage-side base (51) do not come into contact with each other.

In such an assembled state, the respective horizontal partitions (55) of the high-voltage electrode (50) are located substantially in the same plane as the horizontal partitions (45) of the dust collecting electrode (40). Specifically, the high-voltage electrode (50) and the dust collecting electrode (40) are positioned so that the respective first partitions (the horizontal partitions (55)) on the short sides of the end portions (54*a*) of the grid holes (56) of the high-voltage electrode (50) overlap with the second partitions (the horizontal partitions (45)) parallel to the first partitions (55) at the end portions of the dust collecting electrode (40) in the axial direction of the respective grid holes (46, 56). That is, in this embodiment, the dust collecting part (30) is designed so that all the horizontal partitions (55) of the high-voltage electrode (50) invariably overlap with the horizontal partitions (45) of the dust collecting electrode (40) in the axial direction of the grid holes (46, 56) (or in the airflow direction).

The respective vertical partitions (44) of the dust collecting electrode (40) and the respective vertical partitions (54) of the high-voltage electrode (50) are arranged in an alternately staggered pattern in the extending direction of the horizontal partitions (45, 55). With this arrangement, the high-voltage-side protruding plates (52) are located in a central area in the width direction of the grid holes (46) of the dust collecting electrode (40), and the dust-collecting-side protruding plates (42) are located in a central area in the width direction of the grid holes (56) of the high-voltage electrode (50). Also, the high-voltage-side protruding plates (52) are located in a central area in the longitudinal direction of the grid holes (46) of the dust collecting electrode (40), and the dust-collecting-side protruding plates (42) are located in a central area in the longitudinal direction of the grid holes (56) of the high-voltage electrode (50). In the dust-collecting-side base (41), rectangularly cylindrical vent holes through which the air to be processed flows are formed between the inner peripheral faces of the grid holes (46) and the outer peripheral faces of the high-voltage-side protruding plates (52). In the high-voltage-side base (51), rectangularly cylindrical vent holes through which the air to be processed flows are formed between the inner peripheral faces of the grid holes (56) and the outer peripheral faces of the dust-collecting-side protruding plates (42). In this embodiment, the distances between the outer peripheral faces of the high-voltage-side protruding plates (52) and the inner peripheral faces of the grid holes (46) are substantially uniform along the entire periphery. Also, the distances between the outer peripheral faces of the dust-collecting-side protruding plates (42) and the inner peripheral faces of the grid holes (56) are substantially uniform along the entire periphery.

In the dust collecting part (30) having the above structure, when a potential difference is supplied between the dust collecting electrode (40) and the high-voltage electrode (50), electric fields are formed between the dust collecting electrode (40) and the high-voltage electrode (50), and dust collecting surfaces that collect dust from the air to be processed are formed on the surfaces of the dust collecting electrode (40).

Specifically, in the dust-collecting-side base (41), an electric field radially shaped when seen in cross section is formed between the inner peripheral face of each of the grid holes (46) and the outer peripheral face of each corresponding one of the high-voltage-side protruding plates (52). With this arrangement, dust collecting surfaces (48, 48, 48, 48) for collecting positively-charged dust are formed on the inner peripheral faces of each of the grid holes (46). In the high-voltage-side base (51), an electric field radially shaped when seen in cross section is formed between the outer peripheral face of each of the dust-collecting-side protruding plates (42) and the inner peripheral face of each corresponding one of the grid holes (56). With this arrangement, dust collecting surfaces (58, 58, 58, 58) for collecting positively-charged dust are formed on the outer peripheral faces of each of the dust-collecting-side protruding plates (42).

<Operational Behavior>

Next, the operational behavior of the air purifier (10) is described. As shown in FIGS. 1 and 2, when the fan (14) is activated, room air that is the air to be processed is drawn into the air passage (23) in the casing (20), and flows through the air passage (23). In the air purifier (10), a direct-current voltage is applied between each pair of an ionizing wire and an facing electrode, and a direct-current voltage is applied between the dust collecting electrode (40) and the high-voltage electrode (50) of the dust collecting part (30).

The room air drawn into the air passage (23) of the casing (20) first passes through the prefilter (11). The prefilter (11) collects relatively large dust in the room air. The room air having passed through the prefilter (11) flows into the charging part (12). In the charging part (12), relatively small dust having passed through the prefilter (11) is positively charged, and the positively-charged dust flows downstream.

The positively-charged dust then flows, together with the room air, through the dust collecting part (30). As shown in FIG. 5, in the dust collecting part (30), the room air first flows into the dust-collecting-side base (41). In the dust-collecting-side base (41), the room air flows through the vent holes of the grid holes (46). In the dust-collecting-side base (41) at this point, an electric field is formed between the inner peripheral face of each of the grid holes (46) and the outer peripheral face of each corresponding one of the high-voltage-side protruding plates (52). Therefore, the positively-charged dust is attracted and adheres to the dust collecting surfaces (48) on the inner peripheral sides of the grid holes (46). As a result, dust is removed from the room air.

The room air having passed through the dust-collecting-side base (41) then flows into the high-voltage-side base (51). In the high-voltage-side base (51), the room air flows through the vent holes of the grid holes (56). In the high-voltage-side base (51) at this point, an electric field is formed between the inner peripheral face of each of the grid holes (56) and the outer peripheral face of each corresponding one of the dust-collecting-side protruding plates (42). Therefore, the dust remaining in the room air is attracted and adheres to the dust collecting surfaces (58) on the outer peripheries of the dust-collecting-side protruding plates (42). As a result, dust is further removed from the room air.

The air having the dust removed in the dust collecting part (30) then flows through the catalyst filter (13). In the catalyst filter (13), toxic substances and odorous substances in the air are decomposed/removed. The air cleaned in the above manner then passes through the fan (14), and is supplied into the room through the air outlet (22). The air purifier (10) performs the above operation to clean the room air.

<Advantages in Dust Collection of the Dust Collecting Part>

Figure 7:
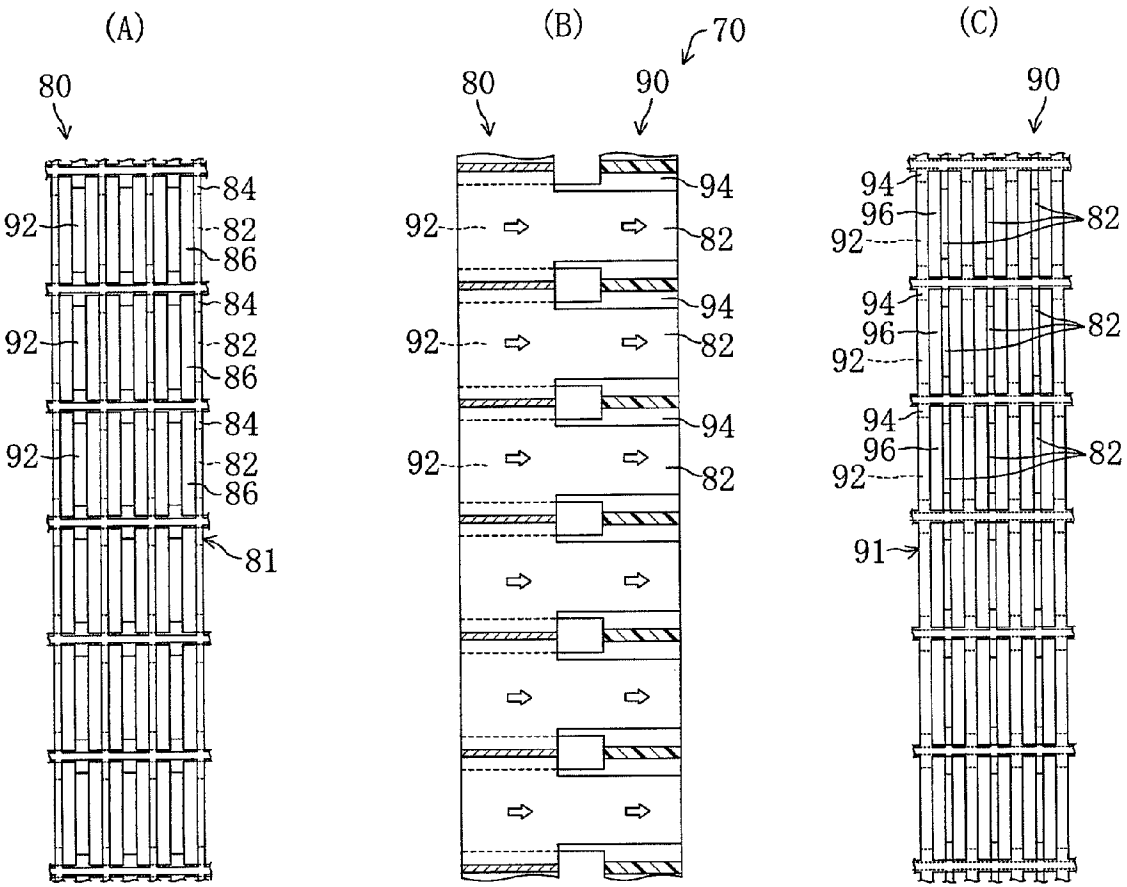
FIG. 7 BACKGROUND ART
FIG. 7 illustrate a situation where a dust collecting electrode and a high-voltage electrode according to a comparative example are assembled together.

In the dust collecting part (30) of this embodiment, the areas of the dust collecting surfaces of the dust collecting electrode (40) are larger than the areas of the dust collecting surfaces of the dust collecting electrode of a comparative example illustrated in FIG. 7, and the dust collecting efficiency is higher in this embodiment. Specifically, in a dust collecting part (70) of the comparative example, each dust-collecting-side protruding plate (82) is formed to correspond to one grid hole (86) in a dust-collecting-side base (81) having a grid structure in a dust collecting electrode (80). That is, in each vertical partition (84) of the dust-collecting-side base (81), each dust-collecting-side protruding plate (82) is formed to be located adjacent to one grid hole (86). In a high-voltage-side base (91) having a grid structure in a high-voltage electrode (90), grid holes (96) are formed so as to correspond to the respective dust-collecting-side protruding plates (82). In each vertical partition (94) of the high-voltage-side base (91), a high-voltage-side protruding plate (92) is formed so as to correspond to one grid hole (96). As described above, in the dust collecting part (70) of the comparative example, the dust collecting electrode (80) and the high-voltage electrode (90) substantially have the same structures, and the aspect ratio of each grid hole (86) of the dust collecting electrode (80) has substantially the same value as the aspect ratio of each grid hole (96) of the high-voltage electrode (90).

In the dust collecting part (30) of this embodiment illustrated in FIGS. 3 through, 5, on the other hand, the dust-collecting-side protruding plates (42) are formed across a plurality of grid holes (46) in the dust-collecting-side base (41) having the grid structure in the dust collecting electrode (40). In the high-voltage-side base (51), the grid holes (56) each having a higher aspect ratio than that of each grid hole (46) of the dust collecting electrode (40) are formed so as to correspond to the dust-collecting-side protruding plates (42). The plurality of high-voltage-side protruding plates (52) are arranged at the end portions (54*a*) on the long sides of the grid holes (56) of the high-voltage-side base (51), so as to correspond to the respective grid holes (46) of the dust-collecting-side base (41).

With this arrangement in the dust collecting part (30) of this embodiment, the same dust collecting surfaces as those of the dust collecting electrode (80) of the described example can be first formed on the inner peripheral surfaces of the grid holes (46) of the dust collecting electrode (40). Further, in the dust collecting electrode (40) of this embodiment, larger dust collecting faces than those of the dust collecting electrode (80) of the described example can be formed on the outer peripheral faces of the dust-collecting-side protruding plates (42). That is, in the dust collecting part (30) of this embodiment, the intervals between the horizontal partitions (55) of the high-voltage electrode (50) are longer than the intervals between the horizontal partitions (45) of the dust collecting electrode (40), and the dust-collecting-side protruding plates (42) can be made longer in the longitudinal direction of the vertical partitions (44) by the corresponding amount. Accordingly, the areas of the outer peripheral faces of the dust-collecting-side protruding plates (42) can also be made larger. With this arrangement in the dust collecting part (30) of this embodiment, dust in the room air can be effectively collected on the downstream side, and a higher dust collecting efficiency is achieved.

Effects of the Embodiment

In this embodiment, each dust-collecting-side protruding plate (42) having a long plate-like shape is formed to extend across three grid holes (46) in the dust collecting electrode (40) as the first electrode, and the grid holes (56) that are elongate holes corresponding to the dust-collecting-side protruding plates (42) are formed in the high-voltage electrode (50). Accordingly, the dust collecting surfaces (48) on the outer peripheral faces of the dust-collecting-side protruding plates (42) can be made larger, and the dust collecting part (30) that is relatively small in size and has a high dust collecting efficiency can be provided.

Also, in the dust collecting electrode (40), the number of dust-collecting-side protruding plates (42) can be made smaller than that in the comparative example. Accordingly, processing the metal plates forming the dust-collecting-side protruding plates (42) becomes easier, and the manufacturing time and costs can be reduced. Further, in the high-voltage electrode (50), the number of horizontal partitions (45) can be made smaller than that in the comparative example. Accordingly, the amount of resin material for forming the high-voltage electrode (50) can be made smaller, and the manufacturing costs can be reduced.

Further, in the high-voltage electrode (50), the grid holes (56) are larger than those of the comparative example. Therefore, the resistance of the vent holes of the grid holes (56) becomes lower, and pressure loss can be reduced. Accordingly, the power for driving the fan (14) can be reduced. Also, as the grid holes (56) are made larger, dust can be prevented from being accumulated in the grid holes (56) and causing clogging.

In the dust collecting part (30), the dust-collecting-side base (41) is placed on the upstream side, and the high-voltage-side base (51) is placed on the downstream side. Since the dust collecting surfaces formed on the inner peripheral faces of the grid holes (46) of the dust-collecting-side base (41) have larger areas than those of the dust collecting surfaces formed on the outer peripheral faces of the dust-collecting-side protruding plates (42), dust in the room air is efficiently removed in the dust-collecting-side base (41), and the dust remaining thereafter can be efficiently removed in the high-voltage-side base (51). That is, since the dust collecting surfaces are formed in accordance with the amount of dust in the air to be processed in the dust collecting part (30), it is possible to efficiently remove dust over a long period of time.

Since the aspect ratio of each of the grid holes (46) is 4 or lower in the dust collecting electrode (40), the areas of the dust collecting surfaces on the inner peripheries of the grid holes (46) become relatively large. Accordingly, the dust collecting part (30) that is small in size and has a high dust collecting efficiency can be provided. Further, since the aspect ratio is 2 or higher, the dust-collecting-side protruding plates (42) can maintain a certain strength.

Further, in the dust collecting part (30) of the above described embodiment, all the horizontal partitions (55) of the high-voltage electrode (50) overlap with the horizontal partitions (45) of the dust collecting electrode (40) in the axial direction of the grid holes (46, 56). With this arrangement, the airflow resistance to the air flowing through each of the grid holes (46, 56) can be lowered. Accordingly, the pressure loss of the dust collecting part (30) can be reduced, and the power for driving the fan (14) can be reduced.

Other Embodiments

In the above described embodiment, each of the dust-collecting-side protruding plates (42) is formed to extend across three adjacent grid holes (46). However, each of the dust-collecting-side protruding plates (42) may be formed to extend across two adjacent grid holes (46) or four or more adjacent grid holes (46).

Figure 6:
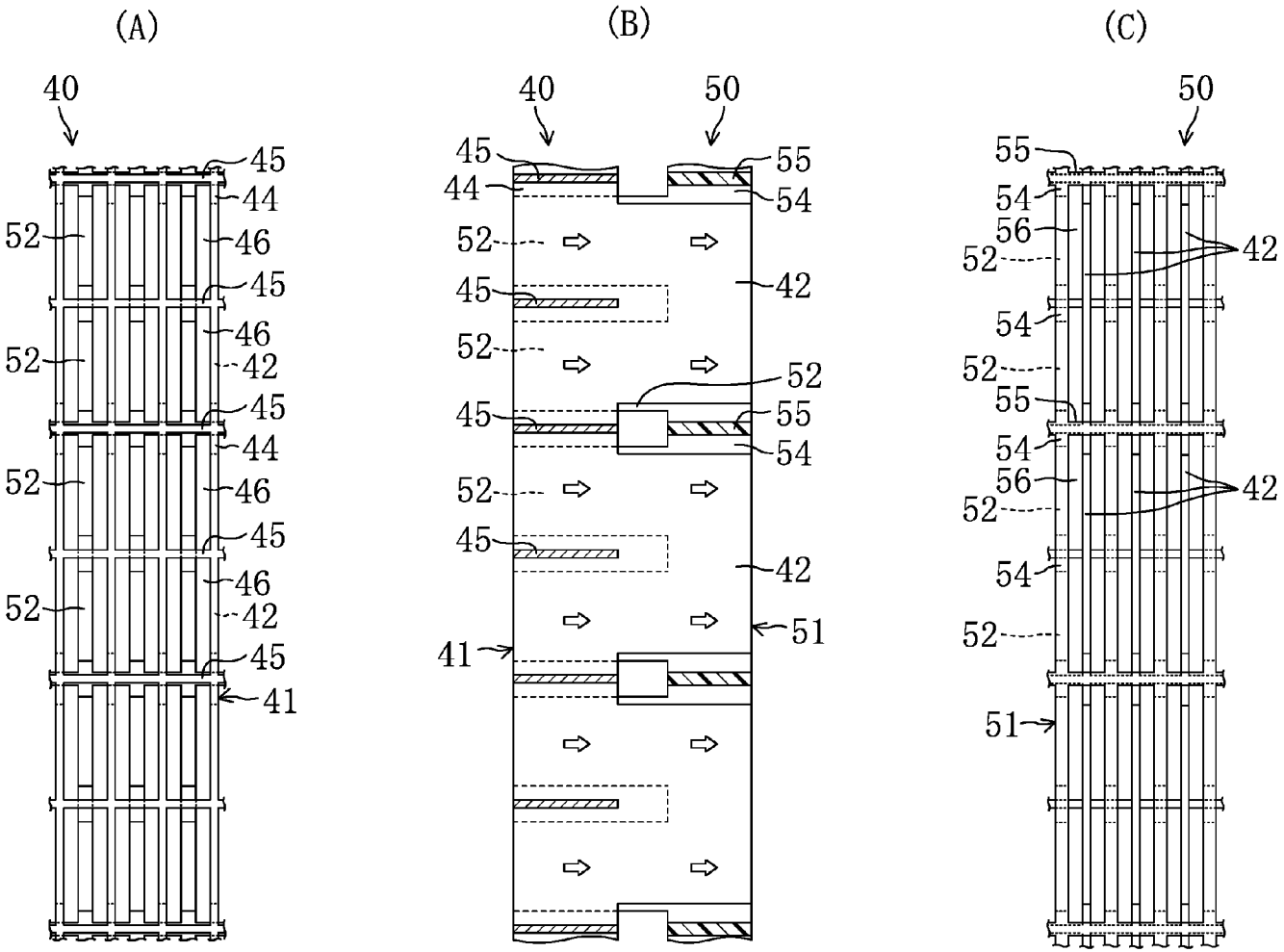
FIG. 6 illustrate a situation where a dust collecting electrode and a high-voltage electrode according to another embodiment are assembled together.

Specifically, the example illustrated in FIG. 6 is an example where each dust-collecting-side protruding plate (42) is formed to extend across two adjacent grid holes (46). In this example, two high-voltage-side protruding plates (52) are arranged in the longitudinal direction at each end portion (54*a*) on the long sides of each grid hole (56) of the high-voltage electrode (50), so that the high-voltage-side protruding plates (52) face the respective grid holes (46) of the dust collecting electrode (40). Accordingly, in the example illustrated in FIG. 6, the areas of the outer peripheral faces of the dust-collecting-side protruding plates (42) can be made larger, and a higher dust collecting efficiency can be achieved.

In the example illustrated in FIG. 6, the aspect ratio of each grid hole (56) of the high-voltage electrode (50) is almost twice higher than (or an integral multiple of) the aspect ratio of each grid hole (46) of the dust collecting electrode (40), and all the horizontal partitions (55) of the high-voltage electrode (50) overlap with the horizontal partitions (45) in the axial direction of the grid holes (46). Accordingly, in the example illustrated in FIG. 6, the airflow resistance to the air flowing through the grid holes (46, 56) can also be lowered, and the pressure loss of the dust collecting part (30) can be reduced.

In the above described embodiment, the dust collecting electrode (40) may be made of a conductive resin material, and the high-voltage electrode (50) may be made of a metal material. Also, the charging part (12) may be designed to charge dust negatively, and the dust collecting electrode (40) may have dust collecting surfaces that collect negatively-charged dust.

In the above described embodiment, the dust-collecting-side base (41) of the dust collecting electrode (40) is placed on the upstream side, and the high-voltage-side base (51) of the high-voltage electrode (50) is placed on the downstream side. However, the high-voltage-side base (51) may be placed on the upstream side, and the dust-collecting-side base (41) may be placed on the downstream side.

INDUSTRIAL APPLICABILITY

As described so far, the present invention is useful for dust collectors that collect dust from the air to be processed onto dust collecting surfaces of electrodes by forming electric fields between the electrodes.

DESCRIPTION OF REFERENCE CHARACTERS

30 dust collecting part (dust collector)
40 dust collecting electrode (first electrode)
41 dust-collecting-side base (base)
42 dust-collecting-side protruding plates (protrusions)
45 horizontal partitions (second partitions)
46 grid holes
50 high-voltage electrode (second electrode)
51 high-voltage-side base (base)
52 high-voltage-side protruding plates (protrusions)
55 horizontal partitions (first partitions)
56 grid holes

The invention claimed is:

1. A dust collector, comprising:

first and second electrodes including bases each having a grid structure, and a plurality of protrusions protruding in an axial direction of grid holes from the bases, respectively, the first and second electrodes being positioned to face each other, each of the protrusions of the first electrode being inserted into each corresponding one of the grid holes of the second electrode, each of the protrusions of the second electrode being inserted into each corresponding one of the grid holes of the first electrode, dust collecting surfaces to collect dust from an air to be processed being formed on surfaces of the first electrode, wherein each of the protrusions of the first electrode is formed to have a long plate shape extending across a plurality of adjacent grid holes of the grid holes the first electrode, each of the grid holes of the second electrode is formed as an elongate hole extending to conform to each corresponding one of the protrusions of the first electrode, and the protrusions of the second electrode are arranged in a longitudinal direction at end portions on long sides of the grid holes of the second electrode, to conform to the respective grid holes of the first electrode.

2. The dust collector of claim 1, wherein each of the protrusions of the first electrode is formed in a long plate shape extending across three or more adjacent grid holes of the grid holes of the first electrode.

3. The dust collector of claim 1 or 2, wherein
the first electrode and the second electrode are positioned so that respective first partitions as short sides of the end portions of the respective grid holes of the second electrode overlap with second partitions of end portions of the grid holes of the first electrode in the axial direction of the grid holes, the second partitions being parallel to the first partitions.

4. The dust collector of claim 1, wherein
the second electrode is made of a conductive resin material.

5. The dust collector of claim 1, wherein
the first electrode is made of a metal material.

6. The dust collector of claim 1, wherein
the base of the first electrode is located closer to an upstream side of a flow of the air to be processed than the base of the second electrode is.

7. The dust collector of claim 1, wherein
an aspect ratio of each of the grid holes of the first electrode is 4 or lower.

* * * * *